US007695407B2

(12) United States Patent
Miller et al.

(10) Patent No.: US 7,695,407 B2
(45) Date of Patent: Apr. 13, 2010

(54) EXERCISE APPARATUS

(76) Inventors: Elwood Bernard Miller, 2766 Ariane Dr., #82, San Diego, CA (US) 92117; Randy Putland, 20 Ebony St., Imperial Beach, CA (US) 91932

( * ) Notice: Subject to any disclaimer, the term of this patent is extended or adjusted under 35 U.S.C. 154(b) by 183 days.

(21) Appl. No.: 11/977,241

(22) Filed: Oct. 24, 2007

(65) Prior Publication Data

US 2008/0096730 A1 Apr. 24, 2008

Related U.S. Application Data

(60) Provisional application No. 60/862,748, filed on Oct. 24, 2006.

(51) Int. Cl.
*A63B 22/16* (2006.01)
*A63B 69/00* (2006.01)
*A63B 71/00* (2006.01)

(52) U.S. Cl. ..... 482/51; 482/148; 434/247

(58) Field of Classification Search ..... 482/51, 482/140, 34, 146–147, 148; D21/399, 412, D21/688, 686, 760, 766; 280/609; 434/247, 434/253

See application file for complete search history.

(56) References Cited

U.S. PATENT DOCUMENTS 3,361,427 A * 1/1968 Paves ..... 482/146
4,749,180 A * 6/1988 Boomer ..... 482/51
4,752,067 A * 6/1988 Colonello ..... 482/140
5,135,249 A * 8/1992 Morris ..... 280/609
5,207,704 A * 5/1993 Shields ..... 606/240
5,702,333 A * 12/1997 Waldron et al. ..... 482/131
5,916,073 A * 6/1999 Ellis ..... 482/140
D417,250 S * 11/1999 Colin ..... D21/766
D418,563 S * 1/2000 Hwang ..... D21/688
6,254,111 B1 * 7/2001 Servant ..... 280/14.22
6,336,895 B1 * 1/2002 Dukes ..... 482/140
6,805,658 B2 * 10/2004 Desberg et al. ..... 482/146
7,169,099 B1 * 1/2007 Kemery et al. ..... 482/146
7,322,910 B2 * 1/2008 Denoth et al. ..... 482/142
7,537,555 B2 * 5/2009 Soletski ..... 482/142
2002/0121752 A1 * 9/2002 Gille et al. ..... 280/18
2003/0060297 A1 * 3/2003 Cembalest ..... 472/88
2004/0132594 A1 * 7/2004 Verna ..... 482/140
2009/0143205 A1 * 6/2009 Jahns ..... 482/140

* cited by examiner

*Primary Examiner*—Steve R Crow
(74) *Attorney, Agent, or Firm*—Greer, Burns & Crain, Ltd.

(57) ABSTRACT

An exercise apparatus having a body including a top surface configured for being stood on by a user, a bottom surface configured for partially resting on a ground surface, a pair of oppositely located side surfaces, a front portion curving in a direction away from the ground, and a back portion oppositely located from the front portion and curving in a direction away from the ground, wherein the bottom surface is configured for enabling rotational and lateral movement of the apparatus relative to the ground.

20 Claims, 3 Drawing Sheets

EXERCISE APPARATUS

This application claims priority of U.S. Provisional Patent Application Ser. No. 60/862,748 filed on Oct. 24, 2006.

BACKGROUND OF THE INVENTION

The present application relates to exercise equipment, and more particularly, to a stand-on exercise apparatus for simulating boarding sports such as skateboarding, snowboarding and surfing.

Surfing, skateboarding, snowboarding and other similar boarding activities are popular outdoor sports which generally require a user to stand on a top surface of the board body and use his legs, arms and abdominal core to maintain balance and turn the board in the desired direction. However, surfing, skateboarding and snowboarding are seasonal sports in most locations and generally cannot be performed during their respective off-seasons (i.e., winter for surfing and skateboarding, summer for snowboarding) without traveling to sites where the sports are in-season, increasing user cost. Also, surfing, skateboarding, snowboarding and the like are typically not performed in inclement weather, further limiting the user's ability to exercise and train in their respective field.

To address this issue, indoor exercise apparatuses have been developed that attempt to simulate such boarding sports. Such conventional apparatuses typically include a flat or planar board having a dowel or similar roller attached to a bottom surface of the board. The user stands on the board and rocks back and forth by shifting his weight between the front foot and the back foot, exercising his arms, legs and abdominal core.

One problem with these conventional apparatuses is that they provide limited exercise by typically only enabling front to back movement. Such limited movement does not fully simulate the acts of surfing, skateboarding and snowboarding, which generally require the user to move the board not only from front to back, but also side-to-side and in some cases, in a rotational orientation. Accordingly, by not adequately simulating the actions of a surfboard, skateboard or snowboard, current exercise boards cannot sufficiently train the user to compete or participate in such sports. Another issue with conventional exercise boards is that because they typically include a dowel or roller device, they can generally only be used on hard or smooth surfaces, such as hardwood floors, cement, or the like.

Conventional exercise boards are also generally relatively heavy and therefore difficult to transport because they are manufactured from wood or other similar, laminate board materials. Further, because of these materials, current exercise boards are generally expensive to produce, increasing the final cost to the user. Also, although the dowel/roller used in current exercise boards is typically manufactured of a weather-resistant alloy or metal, because the boards themselves are manufactured from wood or laminate board, they can warp, breakdown or crack after continued use and exposure to sun, rain and other elements, requiring replacement.

Accordingly, there is a need for an improved exercise apparatus that can be used year-round, that more completely simulates surfing, snowboarding and skateboarding, and is more cost effective and resilient than current exercise boards.

BRIEF SUMMARY

The present exercise apparatus addresses each of the issues raised above by providing an exercise board that can be used year-round and that more accurately simulates the movements required during surfing, snowboarding, skateboarding and other similar boarding sports. Further, the present exercise apparatus is manufactured of a lightweight, durable, all-weather and cost effective material. In addition, the present exercise apparatus is portable and can be easily transported to suit the user's needs.

More particularly, an exercise apparatus is provided and has a body including a top surface configured for being stood on by a user, a bottom surface configured for partially resting on a ground surface, a pair of oppositely located side surfaces, a front portion curving in a direction away from the ground surface, and a back portion oppositely located from the front portion and curving in a direction away from the ground surface, the bottom surface configured for enabling rotational and lateral movement of the apparatus relative to the ground.

DETAILED DESCRIPTION

Figure 1:
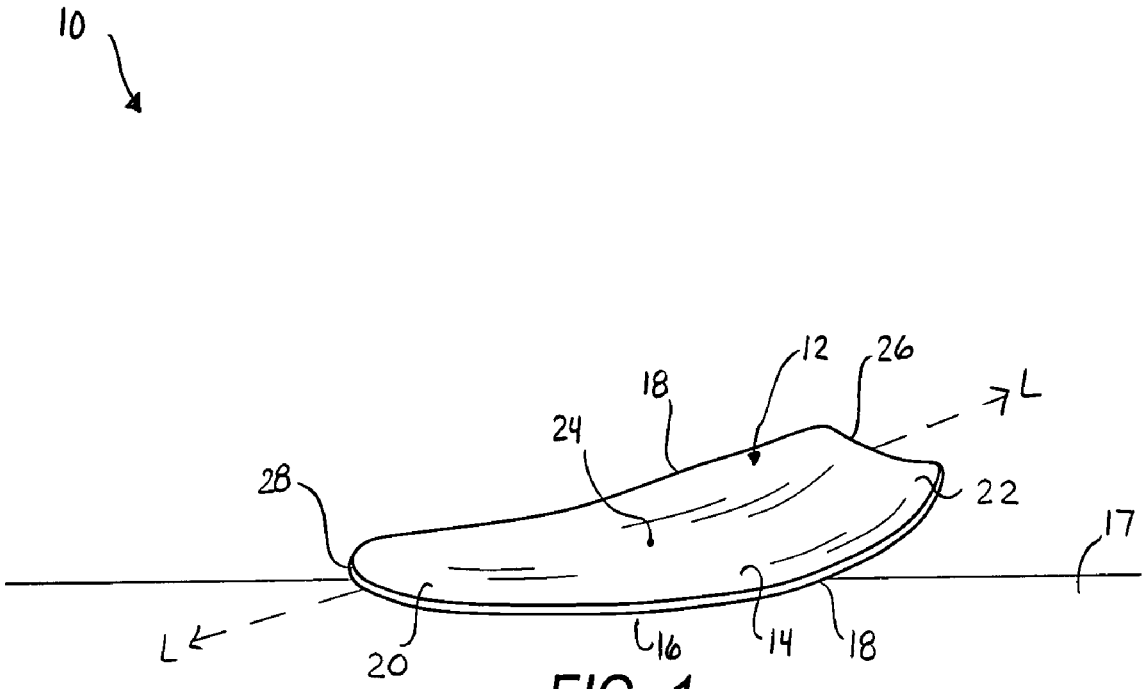
FIG. 1 is a top perspective view of the present exercise apparatus.
Figure 2:
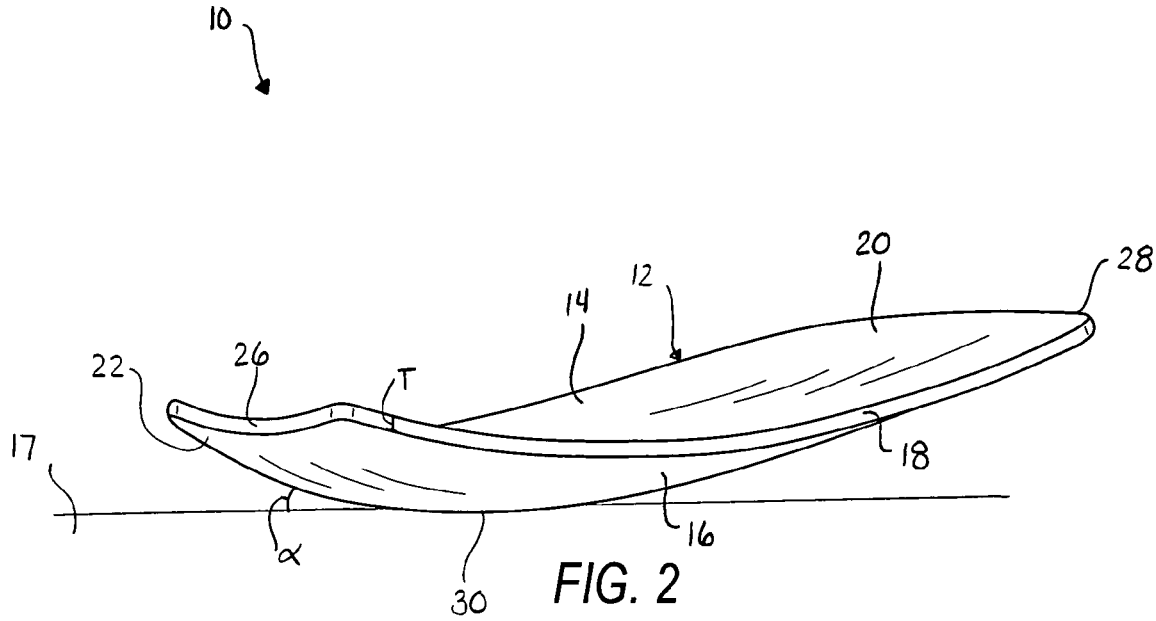
FIG. 2 is a rear perspective view of the present exercise apparatus.
Figure 3:
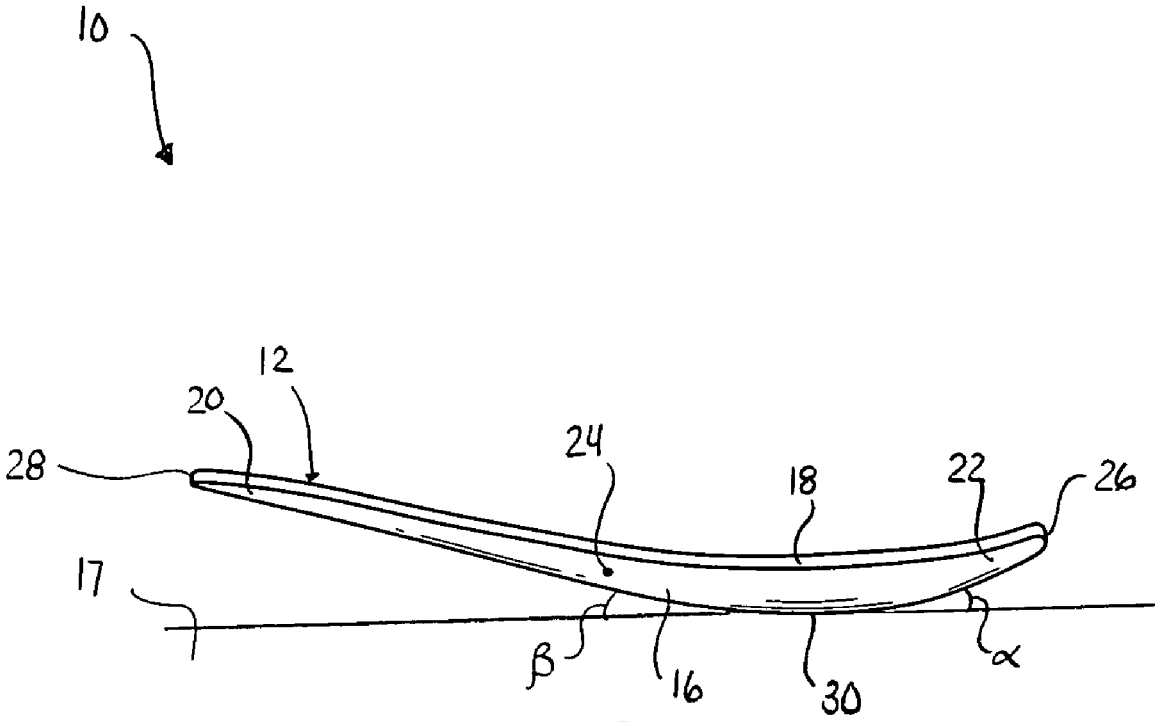
FIG. 3 is a side view of the present exercise apparatus.

Referring now to FIGS. 1-3, an exercise apparatus is provided and is generally designated 10. The apparatus 10 includes a body 12 having a top surface 14 configured for being stood upon by a user and a bottom surface 16 configured for partially resting on a ground surface 17. A pair of oppositely located side surfaces 18 join the top and bottom surfaces 14, 16 together. Preferably, the top surface 14 is concave and the bottom surface 16 is complementarily formed such that the body 12 defines a substantially concave shape.

Specifically, the body 12 includes a front portion 20 and a back portion 22 that respectively extend from a center point 24 of the body, defined along a longitudinal axis "L" of the body. The front and back portions 20, 22, each curve in a direction away from the bottom surface 16. Preferably, when the apparatus 10 is resting on the ground 17, the back portion 22 curves such that an end 26 of the back portion has a height in the range of 4-6 inches from the ground. Similarly, the front portion 20 is curved such that when the apparatus 10 is resting on the ground 17, a tip 28 of the front portion has a height in the range of 1-2 inches from the ground. However, it is recognized that other dimensions may be appropriate to suit the application.

To enable movement in all directions when stood upon by a user, the bottom surface 16 of the apparatus 10 includes a balance point 30 configured for resting on the ground 17 and defining the bottom-most point of the concave-shaped body 12. Preferably, the balance point 30 is located approximately 4-6 inches from the center point 24 of the apparatus 10, as seen in FIG. 3. As described above, the front and back portions 20, 22 each respectively curve in a direction away from the bottom surface 16 and the ground 17. Specifically, the curvature of the apparatus 10 at the back portion 22 defines an angle $\alpha$ in the range of 26-30°, and preferably 28°, between the back portion adjacent the balance point 30 and the ground 17. Further, the curvature of the apparatus 10 at the front portion 20 defines an angle $\beta$ in the range of 10-15° between the front portion adjacent the balance point 30 and the ground 17. It is contemplated that the angles $\alpha$, $\beta$ enable rotational and lateral movement of the apparatus 10 relative to the ground during use, which is described in further detail below.

To further define the concave shape, at the balance point 30, the side surfaces 18 curve in a direction away from the bottom surface 16, such that the side surfaces are approximately one inch away from the ground 17, enabling rocking of the apparatus 10 on all sides of the balance point 30.

Although other shapes may be appropriate, such as a square-shape, the tip 28 of the front portion 20 is preferably substantially rounded, similar to the tip of a surfboard, skateboard or snowboard. Further, the end 26 of the back portion 22 has a substantially square- or concave-shaped end, and has a width preferably in the range of 4-6 inches, although other dimensions may be suitable, depending on the application.

The apparatus 10 preferably progressively narrows in width in both directions from the balance point 30, similar to the shape of a surfboard. Specifically, at the balance point 30, the width of the apparatus is approximately in the range of 10-12 inches, and narrows to a range of 4-6 inches wide at the end 26 of the back portion 20. Similarly, from the balance point 30, the width of the apparatus 10 narrows to a range of 5-8 inches adjacent the tip 28 of the front portion 20. To suit different users and applications, the apparatus 10 can be manufactured in a variety of lengths ranging from 24-32 inches from the tip 28 to the end 26, with a thickness "T" ranging from ¼ to ½ an inch. However, it is recognized that other dimensions for the apparatus 10 may be appropriate, depending on the application.

During use, the apparatus 10 is placed on the ground surface 17, and the user stands upon the top surface 14 with his front foot placed towards the front portion tip 28 and his back foot placed towards the back portion end 26. Specifically, the feet are placed similar to placement on a skateboard, surfboard or snowboard, with feet oriented parallel to each other and transverse to the longitudinal axis "L" of the apparatus 10. To rotate the apparatus 10 between 0-360°, the user twists his body at the torso, using the lower body to control the rotation. It is contemplated that by enabling such 360° orientation, the apparatus 10 more closely simulates the movement of snowboards, surfboards, and skateboards than conventional exercise apparatuses, which typically only permit front to back movement.

If the user wishes to rock back and forth on the apparatus, he shifts his weight between the front and back foot, and the apparatus rocks on the balance point 30, such that either the front portion tip 28 or the back portion end 26 is in contact with the ground 17. The user can also rock side-to-side on the apparatus 10 by shifting his weight to either the left or right, rocking the apparatus on the balance point 30 such that one of the side surfaces 18 is in contact with the ground 17. Accordingly, by using the apparatus 10, the user is exercising his leg muscles when rotating or rocking the board, as well as his upper body and abdominal muscles to maintain balance. Such front to back and side-to-side motion simulates the movements necessary to control surfboards, skateboards, and snowboards, enabling the user to continue with his training regardless of location or the weather.

Although other manufacturing processes may be suitable, the apparatus 10 is preferably injection molded or mold-pressed of polypropylene, polyethylene, or a similar thermoplastic material. It is contemplated that by manufacturing the apparatus from polypropylene or polyethylene, the apparatus will last longer and be more resilient than current exercise boards that are typically manufactured from wood or other similar laminate board materials. Specifically, the apparatus 10 is fade, water and UAV/UVB resistant. Further, the present apparatus 10 is relatively lightweight in comparison to conventional exercise boards. Specifically, the apparatus 10 typically weighs in the range of 3-6 pounds, depending on its length, and accordingly can be easily transported by the user.

To further enhance its applicability, the apparatus 10 can be used both indoors and outdoors, on both solid and wet surfaces alike. Specifically, because of its polypropylene/polyethylene material, the apparatus 10 can be used as a snowboard simulator on snow-covered surfaces, and can also be towed behind a watercraft to simulate surfing. This is in contrast to conventional exercise boards or simulators which are typically designed only for indoor use. However, it is appreciated that other uses for the apparatus 10 may be possible, depending on the application.

While a particular embodiment of the present exercise apparatus has been described herein, it will be appreciated by those skilled in the art that changes and modifications may be made thereto without departing from the invention in its broader aspects and as set forth in the following claims.

The invention claimed is:

1. An exercise apparatus resting on a ground surface and having a body including:

a top surface configured for being stood on by a user;

a bottom surface configured for partially resting on the ground surface at a balance point;

a pair of oppositely located side surfaces;

a front portion curving in a direction away from the ground surface and having a front portion end; and a back portion oppositely located from said front portion and curving in a direction away from the ground surface, said back portion having a back portion end;

wherein said bottom surface is configured for enabling rotational and lateral pivoting movement of the apparatus about the balance point and relative to the ground surface, wherein said front portion end is more distally located from said balance point than said back portion end, and further wherein an angle β defining a curvature of said bottom surface between said front portion adjacent said balance point and the ground surface is in the range of 10-15°.

2. The exercise apparatus of claim 1 wherein the bottom surface is substantially concave-shaped.

3. The exercise apparatus of claim 1 wherein said top surface is a continuous surface.

4. The exercise apparatus of claim 1 wherein said front portion has a substantially square-shaped tip being provided in a range of 1-3 inches from the ground surface.

5. The exercise apparatus of claim 1 wherein an angle α defining a curvature of said bottom surface between said back portion adjacent the balance point and the ground surface is in the range of 26-30°.

6. The exercise apparatus of claim 1 wherein said back portion end is a substantially square-shaped end.

7. The exercise apparatus of claim 6 wherein said back portion end has a width in a range of 4-6 inches.

8. The exercise apparatus of claim 1 wherein said bottom surface includes said balance point configured for resting on the ground, said balance point being located in a range of 4-6 inches from a center point of the apparatus in a direction towards said back portion end, said center point being defined along a longitudinal axis of said body.

9. The exercise apparatus of claim 8 wherein at said balance point, said side surfaces curve in a direction away from said bottom surface.

10. The exercise apparatus of claim 9 wherein said side surfaces curve approximately one inch away from said bottom surface at said balance point.

11. An exercise apparatus resting on a ground surface and having a body configured for being stood upon by a user including:

a top surface having a substantially concave shape;

a bottom surface adjacent to and complementarily shaped to said top surface and having a balance point configured for resting on the ground surface;

a pair of oppositely located side surfaces curving in a direction away from the ground surface at said balance point;

a front portion curving in a direction away from the ground surface and having a front portion end; and a back portion oppositely located from said front portion and curving in a direction away from the ground surface, said back portion having a back portion end;

wherein said balance point is configured for enabling rotational and lateral pivotal movement of the apparatus relative to the ground surface, and wherein said front portion end is more distally located from said balance point than said back portion end, and wherein an angle β defining a curvature of said bottom surface between said front portion adjacent said balance point and the ground surface is in the range of 10-15°.

12. The exercise apparatus of claim 11 wherein said front portion has a substantially square tip being provided in a range of 1-3 inches from the ground surface.

13. The exercise apparatus of claim 11 wherein said front portion has a substantially rounded tip being provided in a range of 1-3 inches from the ground surface.

14. The exercise apparatus of claim 11 wherein said back portion end is located in a range of 4-6 inches from said ground surface.

15. The exercise apparatus of claim 11 wherein said bottom surface is substantially concave-shaped.

16. The exercise apparatus of claim 11 wherein said top surface is a continuous surface.

17. The exercise apparatus of claim 11 wherein the body has a length in a range of 24-32 inches defined along a longitudinal axis of the body.

18. An exercise apparatus resting on a ground surface and having a body configured for being stood upon by a user including:

a top surface having a substantially concave shape;

a continuous bottom surface adjacent to and complementarily shaped to said top surface and having a balance point configured for resting on the ground surface;

a pair of oppositely located side surfaces curving in a direction away from said bottom surface at said balance point;

a front portion having a substantially square-shaped front portion end curving in a direction away from the ground surface; and a back portion having a substantially square-shaped end oppositely located from said front portion end and curving in a direction away from the ground surface, said back portion having a back portion end;

wherein said balance point enables rotational and lateral pivoting movement of the apparatus relative to the ground surface, and wherein said front portion end is more distally located from said balance point than said back portion end.

19. The exercise apparatus of claim 18 wherein an angle β defining a curvature of said bottom surface between said front portion adjacent said balance point and the ground surface is in the range of 10-15°.

20. The exercise apparatus of claim 18 wherein said balance point is located approximately five inches away from a center of said bottom surface in a direction towards said back portion end, and wherein said side surfaces curve approximately one inch from said bottom surface at said balance point.

* * * * *